US009698521B2

(12) United States Patent
Deerberg et al.

(10) Patent No.: US 9,698,521 B2
(45) Date of Patent: Jul. 4, 2017

(54) ELECTRICAL CONNECTION ASSEMBLY

(71) Applicant: Thermo Fisher Scientific (Bremen) GmbH, Bremen (DE)

(72) Inventors: Michael Deerberg, Bremen (DE); Thomas Heise, Oldenburg (DE); Michael Krummen, Bad Zwischenahn (DE); Ronald Seedorf, Weyhe (DE); Tobias Wolf, Sandkrug (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/964,367

(22) Filed: Dec. 9, 2015

(65) Prior Publication Data

US 2016/0172785 A1 Jun. 16, 2016

(30) Foreign Application Priority Data

Dec. 12, 2014 (GB) ..... 1422194.9

(51) Int. Cl.
*H01R 13/53* (2006.01)
*H01R 24/68* (2011.01)

(52) U.S. Cl.
CPC ..... *H01R 13/53* (2013.01); *H01R 24/68* (2013.01)

(58) Field of Classification Search
CPC ..... H01R 24/68; H01R 13/53
USPC ..... 439/628, 181, 921; 174/260
See application file for complete search history.

(56) References Cited

U.S. PATENT DOCUMENTS 3,307,137 A * 2/1967 Tordoff ..... H01R 13/53 174/18
3,388,299 A * 6/1968 Brideweser ..... H01F 27/06 174/37
3,555,487 A * 1/1971 Jones ..... H01J 29/925 439/199
5,393,240 A * 2/1995 Makal ..... H01R 13/53 439/187
5,421,750 A * 6/1995 Crotty ..... H01R 13/53 439/801

(Continued)

FOREIGN PATENT DOCUMENTS

GB 2214003 A 8/2016
JP 2004-080852 A 3/2004

(Continued)

*Primary Examiner* — Abdullah Riyami
*Assistant Examiner* — Nelson R Burgos-Guntin
(74) *Attorney, Agent, or Firm* — David A. Schell

(57) ABSTRACT

A high voltage feedthrough assembly comprises an electrical lead extending in a longitudinal direction and an insulative cover capturing the electrical lead and extending along the electrical lead. The high voltage feedthrough assembly also comprises a flange, the insulative cover extending through and being held by the flange, so that the electrical lead extends through the flange. An adapter body has a cavity extending therethrough, is held in a spaced relation to the flange, the width of the cavity being greater than the width of the insulative cover, wherein a portion of the insulative cover and the electrical lead extending from the flange extends into the cavity. A collar is arranged in the adapter body cavity, extending radially between the adapter body and the insulative cover, to hold the insulative cover and electrical lead so that the insulative cover is radially spaced away from the cavity.

26 Claims, 6 Drawing Sheets

(56) References Cited

U.S. PATENT DOCUMENTS

| | | | | |
|---|---|---|---|---|
| 6,364,216 | B1 * | 4/2002 | Martin | H01R 13/53 439/181 |
| 6,843,685 | B1 * | 1/2005 | Borgstrom | H01R 13/53 439/606 |
| 7,044,769 | B2 * | 5/2006 | Zhao | H01R 13/641 439/489 |
| 7,591,693 | B2 * | 9/2009 | Hughes | H01R 13/18 439/185 |
| 7,803,003 | B2 * | 9/2010 | Hughes | H01R 13/53 439/181 |
| 7,950,939 | B2 * | 5/2011 | Hughes | H01R 13/53 439/181 |
| 9,024,210 | B2 * | 5/2015 | Crisfield | H01R 13/533 174/650 |
| 2006/0035497 | A1 * | 2/2006 | Jazowski | H01R 13/53 439/181 |
| 2007/0287313 | A1 * | 12/2007 | Hughes | H01R 13/53 439/181 |
| 2016/0172785 | A1 * | 6/2016 | Deerberg | H01R 13/53 439/628 |

FOREIGN PATENT DOCUMENTS

| | | | |
|---|---|---|---|
| WO | WO 2009/137178 | A2 | 11/2009 |
| WO | 2012/017320 | A2 | 2/2012 |

* cited by examiner

ELECTRICAL CONNECTION ASSEMBLY

FIELD OF THE INVENTION

The invention relates to an electrical connection assembly and electrical connectors suitable for connecting electrical leads. The invention may be particularly advantageous for use in scientific instruments which require a stable high voltage supply. The described electrical connection assembly and electrical connectors may be implemented within a mass spectrometer.

BACKGROUND TO THE INVENTION

Many scientific instruments require a large number of electrical connections, for example to supply power to modules of the scientific instrument or to allow transmission or receipt of the measurement signals. Some of the electrical connections will carry high voltages (in some cases on the scale of kV). Other connections carry much smaller voltages, for example control or measurement signals of a few V or mV.

When connectors carrying high voltages come into close proximity with a connection to the ground potential (or connectors carrying much lower voltages) there is a risk of an arc or spark. The arc may be formed across an air gap if the breakdown voltage of the air gap is exceeded by the difference between the potential at the two regions. This type of arc or discharge can be hazardous, causing damage to the equipment and injury to the user. Therefore, a sufficient air gap should be maintained to prevent this type of leakage pathway to ground.

Commonly, to connect electrical connections to a scientific instrument the operator will separately connect each individual electrical lead from a bundle of electrical cables. The cables may then trail from each connector at the instrument during use, and may be prone to inadvertent contact or movement. This can result in reduction of the spacing between connectors or leads carrying different voltage, and so discharging events may occur. Furthermore, connection and disconnection of each electrical connection separately is time consuming and leaves room for error. If an unexpectedly high voltage is applied to an incorrect electrical connection at the scientific instrument, damage or hazard can occur.

Micro-discharging is also a particular problem in high voltage connectors. Micro-discharging occurs due to charges accumulating at insulating surfaces close to the high voltage lead. If the spacing between the charged surface and a region of lower potential is too small, a temporary pathway across the insulating surface may formed, thereby allowing for micro-discharging events. These events are observed as relatively small, brief fluctuations in the voltage passed through the connector. For example, when a 10 kV voltage is supplied to the connector, dips of around 1V over 10 ms may be observed due to micro-discharging. As such, micro-discharging cause instability in the voltage supplied through the electrical connection, which can be problematic for certain voltage-sensitive scientific instruments.

A method used to prevent micro-discharging is to provide a sufficient spacing between the electrical lead and regions provided at a lower or ground potential. A steep potential gradient across the surface of the insulator should be avoided. The spacing, d, required to prevent micro-discharging scales exponentially with the voltage difference, $\Delta V$, between the two regions (in other words, $d \propto e^{k\Delta V}$). For example, when situated in air the required spacing between the high-voltage region and ground with an applied voltage of 5 kV must be greater than or equal to 24 mm, whereas the required spacing for an applied voltage of 10 kV must be greater than or equal to 290 mm. The set-up of scientific instruments and their electrical connections can be designed to maintain the required air gap between electrical components, but this becomes more complex and cumbersome where large voltages are required.

Electrical connection to a mass spectrometer can be especially complicated. Not only are a large number of electrical connections required, but a number of the connections must be provided at very high voltages (up to 10 kV). Mass spectrometers require a particularly stable voltage supply to the electrostatic analyser. Even small fluctuations in the supplied potential can disrupt the ion optics and reduce the resolution limit of the instrument. Furthermore, the apparatus is both delicate and of high value, and so avoiding damage due to incorrect configuration of the electrical connections is of paramount importance.

Accordingly, there is a need to provide a method and apparatus for electrical connection to a scientific instrument which reduces the likelihood of micro-discharging events whilst being more convenient and less prone to error. There is further a requirement to provide an electrical connector which reduces the likelihood of micro-discharging in order to maintain a stable applied potential.

SUMMARY OF THE INVENTION

Against this background, there is provided a high voltage feedthrough assembly in which an exposed region of a high voltage lead is maintained having sufficient spacing from a region of ground potential to prevent micro-discharging. The described assembly blocks an air-filled passageway between a region of high potential and ground, thereby preventing charges from passing. Consequently, the spacing required in order to prevent micro-discharging may be reduced. There is further provided an electrical assembly which maintains a required spacing between connectors carrying different voltages, so as to prevent the occurrence of micro-discharging. The plurality of electrical connectors at the electrical assembly may comprise a plurality of the high voltage feedthrough assembly described.

According to a first aspect of the invention, there is provided a high voltage feedthrough assembly comprising an electrical lead extending in a longitudinal direction, and an insulative cover capturing the electrical lead. The insulative cover extends along the electrical lead in the longitudinal direction, and has a width defined in an axis perpendicular to the longitudinal direction. There is further provided a flange, the insulative cover extending through, and being held by, the flange, so that the electrical lead which is captured by the insulative cover extends through, but is insulated from, the flange. The assembly further comprises an adapter body, which is held in a spaced relation to the flange, the adapter body having a cavity extending therethrough, the width of the cavity of the adapter body being greater than the width of the insulative cover, and wherein a portion of the insulative cover and the electrical lead extending from the flange extends into the cavity. Finally, the assembly comprises a collar arranged in the adapter body cavity, extending radially between the adapter body and the insulative cover, to hold the insulative cover and electrical lead so that the insulative cover is radially spaced away from the walls of the cavity in the adapter body and so as to support the adapter body in the said spaced relation to the flange. Advantageously, the adapter is held in a spaced relation to both the insulative sleeve and the flange. This maintains an air gap or spacing surrounding the insulative sleeve. The flange may be grounded, and the air gap may be blocked by the collar such that a passageway through the air gap between the exposed portion of the electrical lead and ground is closed. As a result, the minimum spacing required between the exposed portion of the electrical lead and ground that is sufficient to prevent micro-discharging events is reduced.

The flange may be arranged at the wall of a sealed chamber, in particular a vacuum chamber. The flange may be a vacuum flange which provides a vacuum-tight seal with the wall of the chamber. Where the flange is situated in the wall of a vacuum chamber, the adapter body and at least the portion of the insulative sleeve and electrical lead extending into the cavity of the adapter body may be disposed on the air side of the flange. To prevent micro-discharging, the spacing required between the exposed portion of the electrical lead and ground in air is much greater than in a vacuum.

Preferably, the collar extends contiguously in the radial direction between the adapter body and the insulative cover, so as to block the cavity in the longitudinal direction. The collar barricades a pathway between the tip of the electrical lead and the flange. In particular, the collar blocks a passageway through the air gap. Therefore, micro-discharging events are prevented. The collar may have only a narrow width in the longitudinal direction. Alternatively, the collar may extend in the longitudinal direction through the cavity of the adapter body.

Advantageously, by blocking the passageway through the air gap, the accumulated charges cannot form a temporary pathway across the surface of the insulative sleeve to ground. Therefore, to prevent micro-discharging the required spacing between the exposed portion of the electrical lead and ground may be significantly reduced. As such, the described arrangement may be particularly advantageous when a high voltage feedthrough assembly is required to be exposed to air, outside of a vacuum.

In some alternative configurations, the collar may have small gaps or slits, or may comprise struts arranged to support the insulative sleeve and electrical lead within the cavity of the adapter body. The shape of the collar may be designed to maintain a minimum distance or surface area between the high voltage portion and ground. The minimum distance or spacing is selected to prevent micro-discharging. However, in a preferred example, the collar is a solid body which extends continuously around the insulative sleeve and fills the air gap between the insulative sleeve and the inner wall of the cavity of the adapter body.

Optionally, the spacing in the longitudinal direction between the end of the insulative cover disposed within the cavity of the adapter body, and the face of the flange opposite the adapter body, is a distance D. The distance D may depend on the potential difference between the voltage at the electrical lead and the flange. The distance D may be sufficient to prevent micro-discharging. The distance D will increase as the voltage carried by the electrical lead is increased relative to the voltage at the flange. Specifically, the required distance D scales exponentially with the voltage difference.

The assembly may further comprise a spacer member, arranged to support the insulative cover in a spaced relation to the electrical lead. The spacer member may be formed of the same material as the insulative member and may be a ring or collar-like component which holds the inner surface of the insulative sleeve spaced from the outer surface of the electrical lead. As such, only the spacer member may make direct contact with the electrical lead. In order for the electrical lead to be secured in this position, the electrical lead may be rigid and/or inflexible. In some arrangements the spacer may be formed of a material different to the insulative sleeve, for example a metal. In a particular example, the spacer is formed of a metal cap solidly fixed to the insulating cover and soldered to the central electrode Preferably, the spacer member is formed at an end of the insulative cover that is disposed within the cavity of the adapter body. In other words, the spacer member forms a "cap" at the end of the insulative sleeve through which the electrical lead passes. The spacer may provide a seal for the insulative sleeve around the electrical lead, such that the majority of the length of the electrical lead is not exposed to the air.

Optionally, the spacer member is integrally formed with the insulative cover at an end thereof. For example, the spacer may be formed as part of the insulative sleeve so that the insulative sleeve has a region of smaller inner diameter than the rest of the longitudinal length of the insulative sleeve. This region of smaller inner diameter may act as the spacer to support the electrical lead. The spacer may be integrally formed at an end of the insulative sleeve, or may be formed elsewhere along the length of the insulative sleeve.

The insulative sleeve may be formed as one piece or may be formed in any number of sections. For example, the insulative sleeve may comprise a first section extending into the cavity of the adapter body, and this first section may have a first diameter. The insulative sleeve may further comprise a second section having a different diameter which is provided at the flange and which provides the feedthrough at the flange. In other examples, the insulative sleeve may comprise a third portion being a cap of the insulative sleeve at the end of the insulative sleeve at which the electrical lead is exposed. Said third portion may comprise a cap or closed end to the insulative sleeve, and act as the spacer.

The collar may be arranged at a position on the longitudinal length of the insulative cover that is between the spacer and the flange. Optionally, the collar is arranged at a position on the longitudinal length of the insulative cover that is between the spacer and the face of the adapter body disposed opposite the flange. However, the collar may be placed along almost any portion of the length of the insulative sleeve. The position of the collar should firmly support the adapter body in a position that avoids contact with the flange or the insulative sleeve (and maintains the required air gap therebetween), but which does not put undue stress on the insulative sleeve under the weight of the adapter body.

Preferably, the collar is formed of an insulative material. Advantageously, this prevents charges accumulated at the surface of the insulative sleeve from conducting through the collar. For example, providing the collar formed of an insulative material blockades any conductive pathway between the electrical lead and the face of the flange. This reduces micro-discharging. Furthermore, use of an insulating material for the collar prevents any conductive pathway between the insulative sleeve and the adapter body, which could be held at a different potential to the insulative sleeve due to charging of the insulative sleeve by contact with the electrical lead.

Optionally, the collar is an O-ring. An O-ring provides a close-fitting, continuous support around the insulative sleeve. Furthermore, an O-ring may be formed of a rubberised material which is a good electrical insulator. The O-ring may be situated at a groove or gully on the inner surface of the cavity of the insulative body, in order to hold the collar and prevent movement of the adapter body relative to the insulative sleeve in the longitudinal direction. Alternatively, the collar may be formed of plastic or another material, and may be formed integrally of the adapter body or insulative sleeve, or may be a separate piece.

Advantageously, the adapter body may be formed of an insulative material such as polyacetal. Polyacetal (also known as POM or polyoxymethylene) may be especially beneficial for use as the adapter body. Polyacetal is a thermoplastic that is both stiff and exhibits low friction, therefore the adapter body can be easily shaped whilst maintaining strength and durability.

The high voltage feedthrough assembly described herein may be particularly beneficial for connecting high voltages to a mass spectrometer. This is because a mass spectrometer requires supply of very high voltage to the ion optics (as high as 10 kV, for example). Furthermore, the ion optics are housed in a vacuum chamber. The high-voltage connectors housed on the outer surface of the instrument (which are disposed in air, rather than in a vacuum) are particularly prone to micro-discharges. The micro-discharging events can significantly reduce the resolution of the measurement in the mass spectrometer, for which stability of the potential applied to the ion beam optics is of particular importance. As such, use of the described high voltage feedthrough assembly at the electrical connectors to the mass spectrometer can be particularly advantageous to prevent micro-discharging and increase the stability of the supplied voltage.

According to a second aspect of the present invention there is an electrical connection assembly for a scientific instrument, comprising a plurality of electrical connectors arranged in a flange, for reciprocation with a plurality of electrical sockets at the scientific instrument. The plurality of connectors are arranged in multiple groups, wherein electrical connectors in a first group and electrical connectors in a second group are separated from each other by a distance not less than a distance A. There is also provided a power supply arranged to supply a potential to each of the first group of electrical connectors, the potentials applied across the first group having a first average potential. The power supply is also arranged to supply a potential to each of the second group of electrical connectors, the potentials applied across the second group having a second average potential. The distance A is equal to or greater than a threshold distance dependent on and related to the difference between the first average potential and the second average potential. The plurality of electrical connectors may comprise a plurality of plugs or sockets or a mixture of plugs and sockets. In a particular example, the plurality of electrical connectors comprises a plurality of the high voltage feedthrough assembly.

A range of potentials may be supplied to the connectors of the first group, and a range of potentials may be applied to the connectors of the second group. However, preferably connectors supplied with potential of the same magnitude will be grouped together. Therefore, the first group may comprise connectors supplying a high voltage, for example between 5 kV and 10 kV. The second group may comprise connectors supplying a low potential, for example between 1 and 10V. Connectors supplying potential that is of different magnitude should not be grouped together. The spacing A is determined according to the relative magnitude between the voltage supplied to the first group and the voltage supplied to the second group.

In some configurations, there may be more than two groups of connectors. In fact, there may be any number of groups of connectors within the plurality of connectors. Each group of connectors is separated by a distance from each other group related to the relative magnitude of the potential supplied to the connectors of each group. For example, the connectors may be spaced by a distance which scales with the average potential supplied to each group. For instance, there may be a third group of connectors separated from the first group by a second distance B, and separated from the second group by a third distance C.

Advantageously, the groups of the connectors are arranged at the flange to: a) maintain a minimum spacing or air gap between the groups of connectors that is required to prevent micro-discharging events between groups of connectors carrying different voltages; and b) optimise the spacings between the connectors at the flange. The described arrangement provides a potential gradient across the face of the flange. For example, this is achieved by arranging connectors carrying like voltages in groups to reside in the same region of the flange, and then arranging the groups of connectors such that the voltage supplied to each of the connectors is graduated or "sorted" across the flange. This helps to optimise the spacing of the connectors. For example, a first group of connectors carrying a high voltage may be more closely spaced to a second group of connectors carrying an intermediate voltage than to a third group carrying a relatively low voltage. Therefore, by grouping connectors carrying alike potential, and "sorting" the potential in the manner described, the spacing may be optimised.

Preferably, the distance A is exponentially related to the difference between the first average potential and the second average potential. In other words, the distance d may scale exponentially with the relative magnitude of the potential applied to the first group of connectors compared to the voltage applied to the second group of connectors. The distance A may be sufficient such that the air gap between connectors carrying different potentials does not result in micro-discharging from the connector of high potential to the connector of lower potential. The required spacing may be related to the dielectric strength of components between the regions of high and low potential.

Optionally, the electrical connectors of the first group may be arranged in the flange separated from each other by a distance not less than a distance B. Furthermore, the electrical connectors of the second group may be arranged in the flange separated from each other by a distance not less than a third distance C. The second distance B and the third distance C may be less than the distance A. Beneficially, the connectors within a given group may be more closely spaced than to connectors of other groups, as the difference in potential carried by connectors within the same group is likely to be less. Therefore, a reduced spacing is sufficient to prevent micro-discharges between the connectors in the same group. As above, the specific minimum distance or spacing required between two connectors exponentially scales with the difference in voltage carried by the connectors.

Beneficially, by careful design of the connectors, the spacing between the groups and between connectors of each group can be optimised to reduce the area over which the connectors are arranged whilst still preventing or reducing discharging events. Where there is no significant difference between the voltage carried by the connectors within a group, the connectors within a group may be freely arranged.

Preferably, the electrical connection assembly further comprises a common backplane, each of the plurality of electrical connectors configured to be connected to the common backplane. Furthermore, the connections of the first group of electrical connectors to the backplane may be configured so as to be separated from the connections to the backplane of the second group of electrical connectors, the separation being not less than the distance A. The distance A may be the same minimum distance or spacing as between the groups of connectors arranged at the flange. As before, the minimum distance A scales with the difference in the average potential carried at the connections to the backplane of the first group compared to the average potential carried at the connections to the backplane of the second group. More specifically, the minimum distance scales exponentially with the difference in the potential. Ideally, the connections to the backplane are ordered or sorted across the planar surface of backplane in order to provide an electrical potential gradient across the connections.

Optionally, the connections to the backplane of each of the first group of electrical connectors are separated from each other by a spacing not less than the second distance B. Furthermore, the connections to the backplane of each of the second group of electrical connectors may be separated from each other by a spacing not less than the third distance C. Preferably, the spacing B and C are the same as the spacing between connectors of the first group and connectors of the second group at the flange, as described above. The spacings B and C may be less than the spacing A.

Preferably, the electrical connection assembly comprises a plurality of rigid wires, a rigid wire from the plurality of rigid wires arranged to connect each of the plurality of electrical connectors to the common backplane. Each of the rigid wires may be shaped to maintain a spaced relation from each other. In particular, each of the rigid wires connecting the first group of electrical connectors to the backplane may be separated from each of the rigid wires connecting the second group of electrical connectors to the backplane by a spacing not less than the distance A, wherein the spacing of distance A is maintained along the full length of the rigid wire. The rigid wires may be bent into a suitable shape such that the wires are configured to maintain a minimum spacing therebetween. The minimum spacing required between the rigid wires is related to a distance required to prevent micro-discharges occurring when a differing potential is carried by each of the wires. In particular, the spacing is maintained at a distance A, which may be equal to the distance A discussed above and provided between the first and second group of electrical connectors at the flange, as well as between the first and second connectors at the backplane.

Advantageously, the spacing A is maintained between every connector element or component carrying different voltages within the electrical connection assembly. For example, the spacing is maintained between the connectors of the first group and second group at the flange, between the rigid wires of the first and second group, and between the connections of the wires of the first group to the backplane compared with the connections of the wires of the second group to the backplane. Beneficially, use of rigid wires and use of a backplane provides an immovable configuration, having fixed spacing. Advantageously, this prevents the spacing between potential carrying pathways being accidentally reduced, thereby allowing micro-discharging or even sparks or arcs to occur.

Optionally, each of the rigid wires connecting the first group of electrical connectors to the common backplane are shaped to maintain a spacing from each other not less than the second distance B. Furthermore, each of the rigid wires connecting the second group of electrical connectors to the common backplane may be shaped to maintain a spacing from each other not less than the third distance C. The second and third spacing may be the same as described above with relation to the spacing of the connectors within the first and second group at the flange. Furthermore, the spacing B and C may be less than the spacing A.

Ideally, there may be provided a push connector at each of the plurality of electrical connectors. The push connector is configured for reciprocation with an electrical lead at an electrical socket at the scientific instrument. The push connector may be gold plated. Advantageously, the push connectors may be connected at the connector to an end of a rigid wire. The push connectors may be configured to receive the tip of an electrical lead of a plug or socket reciprocating with each electrical connector. The tip of the electrical lead may thrust against the push connector, which may be biased against the conjoining electrical lead or rigid wire using a spring or other biasing means. Therefore, a good electrical contact is made between the electrical lead, the push connector and the rigid wire. Beneficially, use of push connectors reduces the formation of air gaps between the electrical lead and the push connector. In some examples, the push connectors may also be provided between the rigid wire and the backplane. Here, the push connector is arranged to be biased against the connection wire or pin at the backplane, and thereby reduce the likelihood of air gaps being formed between the components for the connection. As such the occurrence of micro-discharging may be reduced.

Optionally, the components may be joined using a two-component solder. For example, the rigid wire may be connected to each push connector via a two-component solder. Use of this connective material provides improved electrical contact (with low resistance).

Preferably, the described electrical connection assembly further comprises a closed cabinet. The flange described above may be arranged in a wall of the cabinet, and the common backplane may be mounted within the interior of the closed cabinet. The closed cabinet may be a sealed or sealable cabinet. In some circumstances, the cabinet may be pressurised, for example containing a vacuum. Advantageously, use of a closed cabinet allows the plurality of connectors, rigid wires and the backplane to be moved together relative to the scientific instrument, such that each of the plurality of connectors can be connected or disconnected simultaneously. Therefore, the use of a cabinet avoids the requirement for the operator to connect and disconnect each individual electrical connector separately. As such, the likelihood of incorrect connection of the electrical connectors is reduced. The fixed nature of the connectors, rigid wiring and backplane at the cabinet allow the cabinet to act as a module. Therefore, interchangeable cabinets may be used for connection to the electrical sockets at a scientific instrument.

Ideally, the interior of the closed cabinet is electrically insulated from the exterior of the closed cabinet. In other words, the cabinet provides a completely closed module for supply of potential to all of the plurality of electrical connectors.

Preferably, the closed cabinet further comprises an air conditioning module for control of the temperature and humidity at the interior of the cabinet. The cabinet may be used to maintain the interior of the cabinet at a fixed temperature. Beneficially, this can improve the stability of the potential carried by connections within the cabinet to the connectors. This is because the temperature constant ($T_C$) of the wiring may be very sensitive to fluctuations in temperature, especially for high-voltage connections. As such, it is beneficial if a constant temperature is maintained, as this increases the stability of the voltage supplied through the connections. In some circumstances, a low (or high) pressure may be maintained in the cabinet, or the closed cabinet may contain a vacuum.

Preferably, the closed cabinet is rail mounted such that it can be moved on the rail relative to the scientific instrument, between a first position in which the plurality of electrical connections are connected to the scientific instrument, and a second position in which the plurality of electrical connections are disconnected from the scientific instrument. In other words, the rail allows the cabinet to be moved relative to the scientific instrument for connection or disconnection of each of the plurality of electrical connectors simultaneously. Connection or disconnection of the plurality of connections may be required, for example, for maintenance of the scientific instrument. The rail mounting of the cabinet allows for easier movement of the electrical connection cabinet and more convenient disconnection of the plurality of electrical connectors. Furthermore, use of a rail mounting improves alignment of the connectors at the cabinet with the reciprocating sockets at the scientific instrument.

Optionally, the electrical connection assembly comprises an alignment device at the cabinet, configured to align the plurality of electrical connectors at the cabinet with the plurality of electrical sockets at the scientific instrument. The alignment device may be a pin at the outer surface of the cabinet or flange which is received by a aperture or cavity in the face of the scientific instrument (or vice versa). Alternatively, the alignment device may comprise a mark on the cabinet or flange and the scientific instrument, which can be visually aligned by the user. Beneficially, the alignment device assists in correct alignment of the electrical connectors in the flange or cabinet with the reciprocating sockets of the scientific instrument. Thus, the alignment device helps prevent damage to the electrical connectors due to incorrect connection.

In a further aspect, a mass spectrometer comprises the electrical connection assembly described herein. In one example, a plurality of the high voltage feedthrough assembly may be comprised at an outer wall of the mass spectrometer, and the plurality of electrical connectors forming part of the electrical connection assembly described above may be arranged to reciprocate.

LIST OF FIGURES

A high voltage feedthrough assembly and an electrical assembly in accordance with an aspect of the present disclosure is described, by way of example only, with reference to the following drawings, in which.

Where appropriate, like reference numerals denote like elements in the Figures. The Figures are not to scale.

DETAILED DESCRIPTION OF THE INVENTION

Figure 1A:
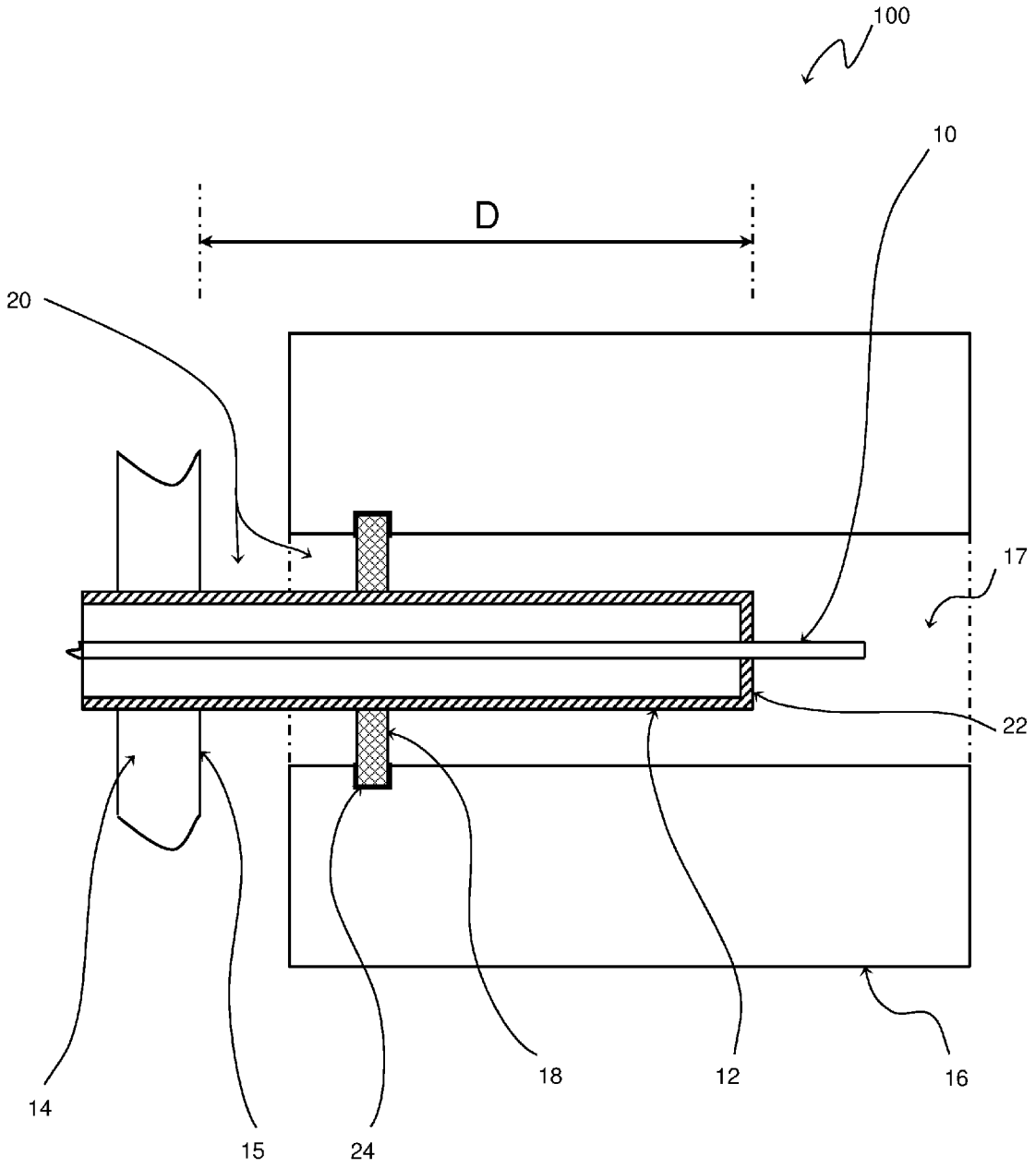
FIG. 1A is a cross-sectional view of an embodiment of the high voltage feedthrough assembly.
Figure 1B:
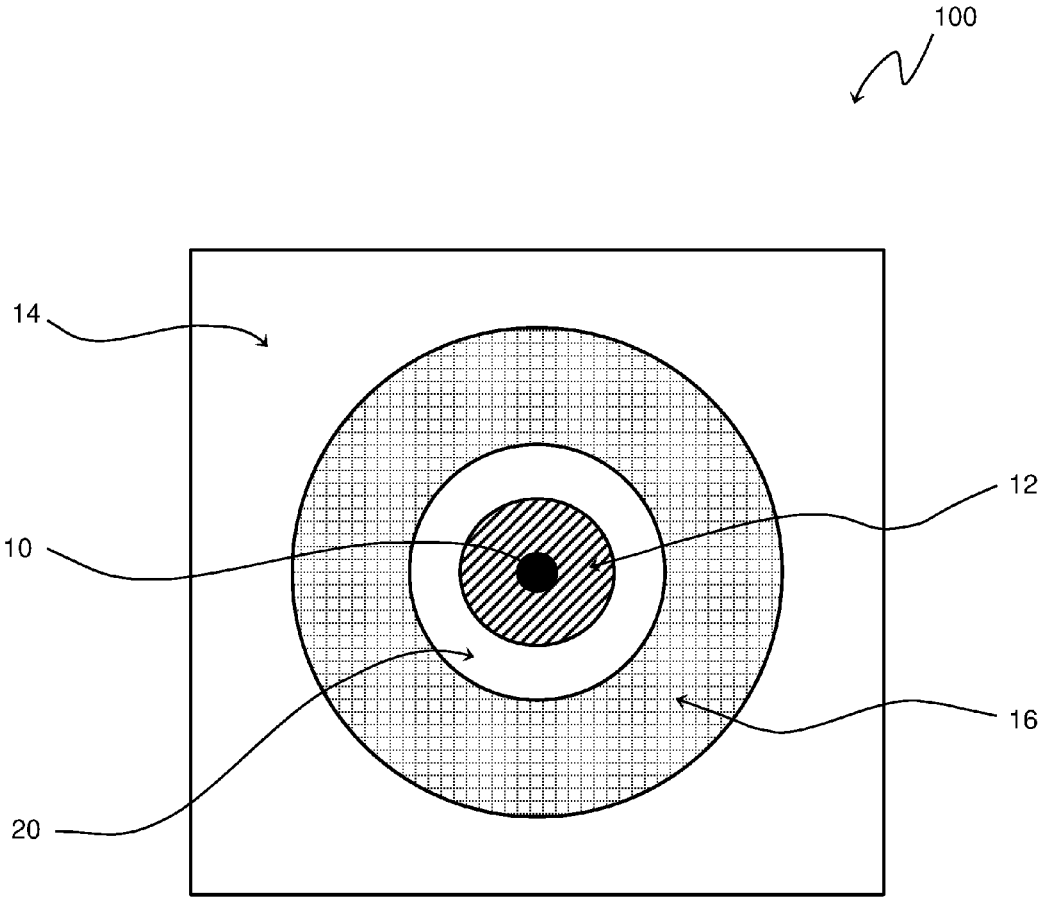
FIG. 1B is a side view of the high voltage feedthrough assembly of FIG. 1A.

Referring first to FIG. 1A and FIG. 1B, there is a high voltage feedthrough assembly 100. FIG. 1A shows the assembly 100 in cross-section, and FIG. 1B shows the same assembly 100 from a side view, looking towards the tip of the electrical lead and looking along the longitudinal axis of an electrical lead.

The assembly includes a high voltage lead 10 which is arranged to carry a potential V. An insulative sleeve 12 captures or houses the electrical lead 10 such that the insulative sleeve 12 forms a cover or shroud that is wrapped around most of the length of the electrical lead 10. Only at one end is the electrical lead 10 exposed from the insulative sleeve 12. This exposed portion of the electrical lead 10 can be arranged to make electrical contact with a reciprocating electrical plug or connector.

The insulative sleeve 12 and electrical lead 10 are arranged within a flange 14 at a face of the scientific instrument or at the face of a cabinet of a power supply. The flange 14 firmly holds the rigid insulative sleeve 12 and electrical lead 10, so that the insulative sleeve 12 and electrical lead 10 extends through the flange 14 to pass into (or out of) the cabinet or container in which the flange 14 is arranged. The outer end of the insulative sleeve 12 and electrical lead 10 protrude from the outer face 15 of the flange 14. The insulative sleeve 12 is arranged such that the outer end of the insulative sleeve 12 is spaced a minimum distance D from the outer face 15 of the flange 14. A seal between the insulative sleeve 12 and the flange 14 may be provided such that a vacuum in the cabinet in which the flange 14 is arrange can be maintained.

In the example illustrated in FIGS. 1A and 1B, the insulative sleeve 12 includes a spacer 22, which holds the insulative sleeve 12 in a spaced configuration from the electrical lead 10. The spacer 22 is formed at the end of the insulative sleeve 12 that protrudes from the outer edge of the flange 14, furthest from the outer face 15 of the flange 14. In the illustrated example, the spacer 22 is integrally formed in the insulative sleeve 12. Here, the spacer 22 forms a cap or seal to the insulative sleeve 12 and the air gap or spaced region present between the electrical lead 10 and the inner walls of the insulative sleeve 12. The electrical lead 10 and spacer 22 are both formed from rigid materials. For example, the insulative sleeve 12 may be formed of ceramic, and the electrical lead 10 may be a low resistance rigid wire.

An adapter body 16 is positioned in a spaced relation to the outer face 15 of the flange 14. The adapter body 16 has a cavity 17 or bore extending through its centre. The walls of the cavity 17 or bore are thick in comparison to the walls of the insulative sleeve 12. The portion of the insulative sleeve 12 and electrical wire 10 which protrude from the outer face 15 of the flange 14 are arranged to extend into the cavity 17 within the adapter 16. The insulative sleeve 12 is positioned in the cavity 17 of the adapter 16 so that the exposed portion of the electrical lead 10 is arranged within the cavity 17 of the adapter body 16. Furthermore, the adapter body 16 is positioned such that a spacing or air gap 20 is maintained both radially around the insulative sleeve 12, and also with respect to the outer face 15 of the flange 14.

The adapter 16 is held in this spaced relation by use of a collar or gasket 18 that is arranged around the insulative sleeve 12. Specifically, the collar 18 extends between the outer surface of the insulative sleeve 12 and the inner surface of the cavity 17 within the adapter body 16. The collar 18 holds the adapter body 16 firmly in position. As such an air gap 20 is maintained around the insulative body 12 and between the adapter body 16 and the flange 14. Furthermore, a minimum distance D is maintained between the end of the insulative sleeve 22 adjoining the exposed portion of the electrical lead 10 and the outer face 15 of the flange 14.

In the example shown in FIGS. 1A and 1B, the collar 18 forms a complete ring around the insulative body 12. As can be seen at FIG. 1B, the collar 12 is contiguous between the surface of the insulative sleeve 12 radially outward to the inner wall of the cavity 17 of the adapter 16. Therefore, the collar 18 forms a complete, unbroken disc which barriers or blockades the air gap 20 around the insulative body 12. The collar 18 is arranged so that there is no open passageway through the cavity 17 in the adapter body 16 between the tip of the electrical lead 10 and the outer face 15 of the flange 14. Here, the collar 18 is an O-ring (made of a rubberised material) which is located in a gulley 24 in the inner surface of the cavity 17 of the adapter body 16. The diameter of the O-ring is selected to tightly fit around the insulative sleeve 12.

In use, a high voltage power supply can be connected to the electrical lead 10. The flange 14 can be connected to ground. The spacing D between the outer portion of the insulative sleeve 12 (here, spacer 22) and the outer face 15 of the adapter flange 14 (e.g. the face opposite the adapter portion) provides a particular surface insulation length. The minimum spacing D is chosen to be sufficient such that micro-discharges do not occur for a given voltage supplied to the connector assembly 100. As such, any given connector assembly 100 may be rated for carrying a specific voltage, according to the distance D. The value of distance D will increase exponentially as the voltage to be carried is increased.

Beneficially, in the described configuration an air gap 20 is maintained surrounding the insulative sleeve. The collar 18 interrupts and blocks the air gap 20 between the high voltage lead 10 and the face 15 of the flange 14 (which is connected to ground). Therefore, charges generated at the surface of the insulative sleeve 12 closest to the tip or exposed portion of the electrical lead 10 are not able to form a pathway to ground. As such, micro-discharging for a given spacing is markedly reduced. Furthermore, the distance D required to prevent micro-discharging will be considerably reduced compared to an assembly in which the collar is not provided.

In the absence of the collar, the lowest resistance path to ground for any accumulated charges at the insulative sleeve is along the surface of the insulative sleeve, through the air. This is because the conductivity of air is higher than other components of the assembly connecting the electrical lead to ground (for example, compared to the conductivity of the insulative sleeve itself). In the described configuration, the collar blocks the air gap and so considerably increases the resistance of the pathway to ground. The spacing required between the exposed region of the high voltage lead and ground is therefore dependent on the lowest resistance remaining pathway to ground, as well as the applied potential.

The insulative sleeve itself may not be a perfect insulator. For example, although the conductivity of a ceramic insulative sleeve may be much lower than that of air, the conductivity is still finite. Therefore, with a high enough potential gradient placed across the insulative sleeve, the insulative sleeve will itself provide a route to ground for the accumulated charges. As such, in the described assembly, in order to prevent micro-discharging the required spacing D still requires a spacing sufficient to prevent conduction of accumulated charges through the insulative sleeve.

Various modifications to the high voltage assembly 100 will also be apparent to the skilled person. For example, the insulative sleeve 12 may be comprised of a single part which extends continuously from the cavity of the adapter body, thorough the flange 14 and into the scientific instrument. Alternatively, the insulative sleeve 12 may be comprised of a first and second section. For example, the first section may be positioned at the intersection with the flange 14, and a second section may be connected to the first section and extending into the cavity 17 of the adapter flange 16. The sections may be of the same diameter, or of different diameters. In either case, the insulative sleeve 12 provides an insulating layer surrounding the majority of the longitudinal length of the electrical lead 10 within the connector assembly 100.

Although the insulative sleeve 12 in the presently described example comprises a spacer 22 (to support the insulative sleeve 12 in a spaced relation to the electrical lead 10), no spacer 22 is required. Furthermore, although in the described example the spacer 22 is shown as residing at the end of the insulative sleeve 12, the spacer 22 may be located anywhere along the length of the insulative sleeve 12, such that the insulative sleeve 12 is supported in a spaced relation to the electrical wire 10. Furthermore, in some embodiments no spacer is present, such that the insulative sleeve 12 is in direct contact with the electrical lead 10 along much of its length.

In the examples illustrated in FIGS. 1A and 1B, the collar 18 comprises an O-ring provided in a gully, notch or contour 24 at the inner wall of the adapter cavity 17. However, the collar 18 could be integrally formed with the adapter body 16 or the insulative sleeve 12. Alternatively, the collar 18 could be connected to the adapter body 16 or insulative sleeve 12 via another means. Furthermore, the collar 18 need not be an O-ring, but could be a plastic collar, or a collar made of another material. Ideally, the material will be insulating.

The insulative sleeve may be formed of any material which has low conductivity and a high dielectric strength. For example, the insulating sleeve may comprise ceramic or glass.

In the example described above, the collar 18 is a contiguous body which extends between the insulative sleeve 12 and the inner walls of the cavity 17 of the adapter body 16, provided around the insulative member 12 without gaps or holes. Although this may be the most advantageous configuration for the collar 18, the collar 18 may be provided having small holes, gaps or slits within the collar 18.

The electrical lead 10, insulative sleeve 12 and cavity 17 of the adapter flange 16 are presented as having a circular cross-section in the direction perpendicular to the longitudinal direction of the electrical lead 10. However, the cross-section may equally be square or of any other shape, providing a minimum air gap is provided around the insulating sleeve 12.

Although not shown in FIGS. 1A and 1B, the assembly 100 can be connected to a reciprocating socket such that the electrical lead 10 is connected to an electrical contact. The electrical lead 10 can be configured to supply to or receive an electrical signal from the electrical contact at the socket.

In the examples of FIGS. 1A and 1B, the adapter body 16 forms a body around a single insulative sleeve 12 and electrical lead 10. However, the adapter body 16 may be shared with a number of insulative sleeves and electrical leads. As such, the adapter body 16 may form the body of a "plug". In this case, each insulative sleeve and electrical lead would be housed in a dedicated cavity or bore through the adapter body according to the described configuration.

Figure 2:
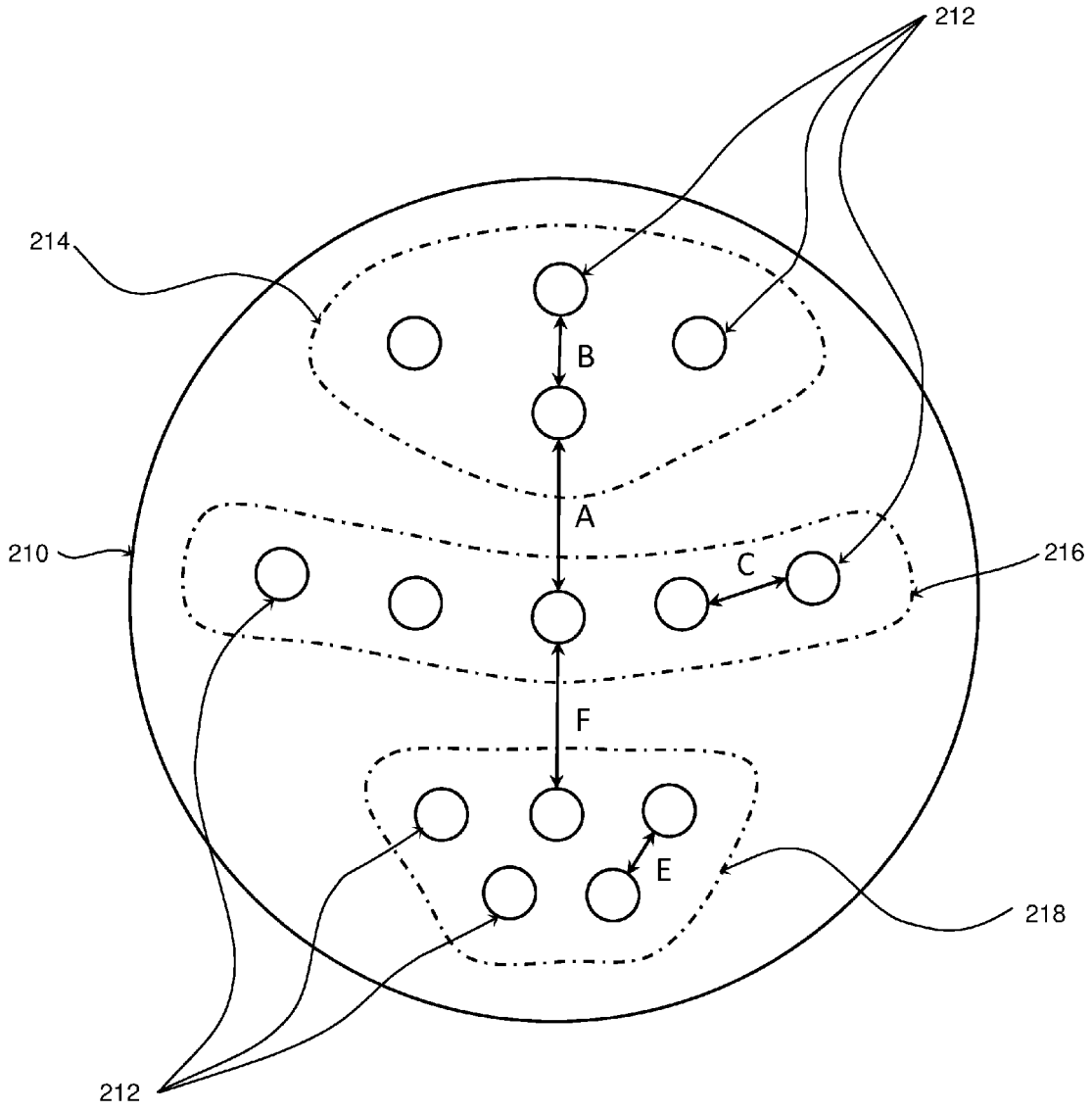
FIG. 2 is a schematic view of an electrical assembly comprising a flange having a plurality of electrical connectors.

FIG. 2 shows the outer surface of a flange or feedthrough 210. A number of connectors 212 are arranged in the surface of the flange 210. The connectors 212 can reciprocate with plugs or sockets at a scientific instrument.

The plurality of connectors 212 are arranged in groups. In this example, the plurality of connectors 212 are arranged in a first group 214, a second group 216, and a third group 218. The connectors 212 are arranged in the flange 210 such that each of the first group of connectors 214 are arranged having a minimum spacing A from each of the second group of connectors 216. The spacing A must be not less than a predetermined spacing.

A power supply (not shown) is connected to each of the connectors 212. The power supply is arranged to supply a voltage to each connector 212. In a particular example, the power supply is arranged to supply a first, high average voltage (such as 10 kV) to the first group of connectors 214, and a second, lower average voltage to the second group of connectors 216 (for example 100V). The minimum spacing A between the first and second group of connectors 214, 216 is related to the potential difference between the first and second average voltage. For example, the distance A may have an exponential relationship to the potential difference between the first and second voltage. In the example presented above, the potential difference will be around 9.9 kV and the spacing A would be required to be around 290 mm.

The connectors 212 are grouped such that alike potentials are applied to the connectors within a group. Therefore, in the described example, the connectors in the first group 214 might carry voltages in the kV range, whereas the voltage carried by the second group 216 might be just a few volts. In general, the connectors of each group carry a voltage of the same magnitude as other connectors in the same group. Therefore, the spacing A scales with the difference in magnitude of the voltage carried by the two groups 214, 216. The greater the potential difference, the larger the spacing that is required. The spacing is the distance sufficient to avoid micro-discharging at connectors carrying differing potential.

Further groups of pins can be arranged at the flange, each being connected to a power supply. For example, the third group of connectors 218 can be arranged spaced from both the first and second group 214, 216. The spacing F between the second and third group 216, 218 is once again proportional to the difference in the voltage supplied to each group by the power supply. Where there is a large potential difference, a much larger spacing between the groups is provided. In use, the connectors 212 may each carry a different voltage to others in the group. However, all connectors within a group will carry a voltage of similar magnitude.

Ideally, the spacing can be optimised by sorting the groups of connectors 214, 216, 218 at the face of the flange 210. Therefore, in the example shown, the second group 216 might carry an average potential that is intermediate the high voltages carried by the first group 214 and the very low voltages carried by the third group 218. For example, the illustrated assembly could be arranged such that the first group 214 carry voltages in the kilovolt (kV) range, the second group 216 carry voltages in the volt (V) range, and the third group 218 carry voltages in the millivolt (mV) range. The spacing A and F are then chosen according to the potential difference between the groups. As such, a much greater spacing is required between the first 214 and third 218 group than between the first group 214 and second group 216 or second group 216 and third group 218. Thus, placing the second group 216 between the third group 218 minimises the overall area over which the connectors are arranged.

Accordingly, the electrical connectors 212 are "sorted" in the flange 210 so that a potential gradient of the voltage carried by the connections 212 is provided.

Appropriate spacings are provided between each connector 212 to maintain an air gap that avoids micro-discharging between the pins. However, the described arrangement optimises the arrangement of the pins such that the spacings are minimised. Within each group, the electrical connectors 212 are also arranged spaced from each other. For example, each connector within the first group of connectors 214 are spaced by a distance not less than a distance B from each other. The connectors within the second group 216 are spaced from each other by a distance not less than a distance C. Similarly, the connectors in the third group 218 are spaced from each other by a distance not less than E. Distances B, C and E are related to the potential difference between the voltage carried by each of the connectors within the group. The distance is chosen to maintain the air gap required to prevent micro-discharging between the connectors.

As the skilled person will appreciate, although only three groups of connectors are described herein, any number of groups of connectors could be arranged at the flange. The connectors would be arranged in order to sort the groups within the flange according to the average voltage carried by the connectors within each group. Therefore, a gradient in the applied potential is established across the connectors at the flange.

The distances required between groups of connectors in order to prevent micro-discharging dependent on a number of factors. The distance required between electrodes will depend both on the potential difference, and also on the electric strength of the medium through which charges may be passed. At connectors carrying high voltages, micro-discharging occurs through movement of accumulated charge at the surface of an insulator. This occurs due to the low dielectric strength of air compared to the insulative material. As such, the voltage difference that can be applied between the two electrodes before the occurrence of micro-discharging will be greater when either the distance or surface area between the two electrodes is increased, or alternatively if the dielectric constant of the pathway between the two electrode is increased.

Figure 3:
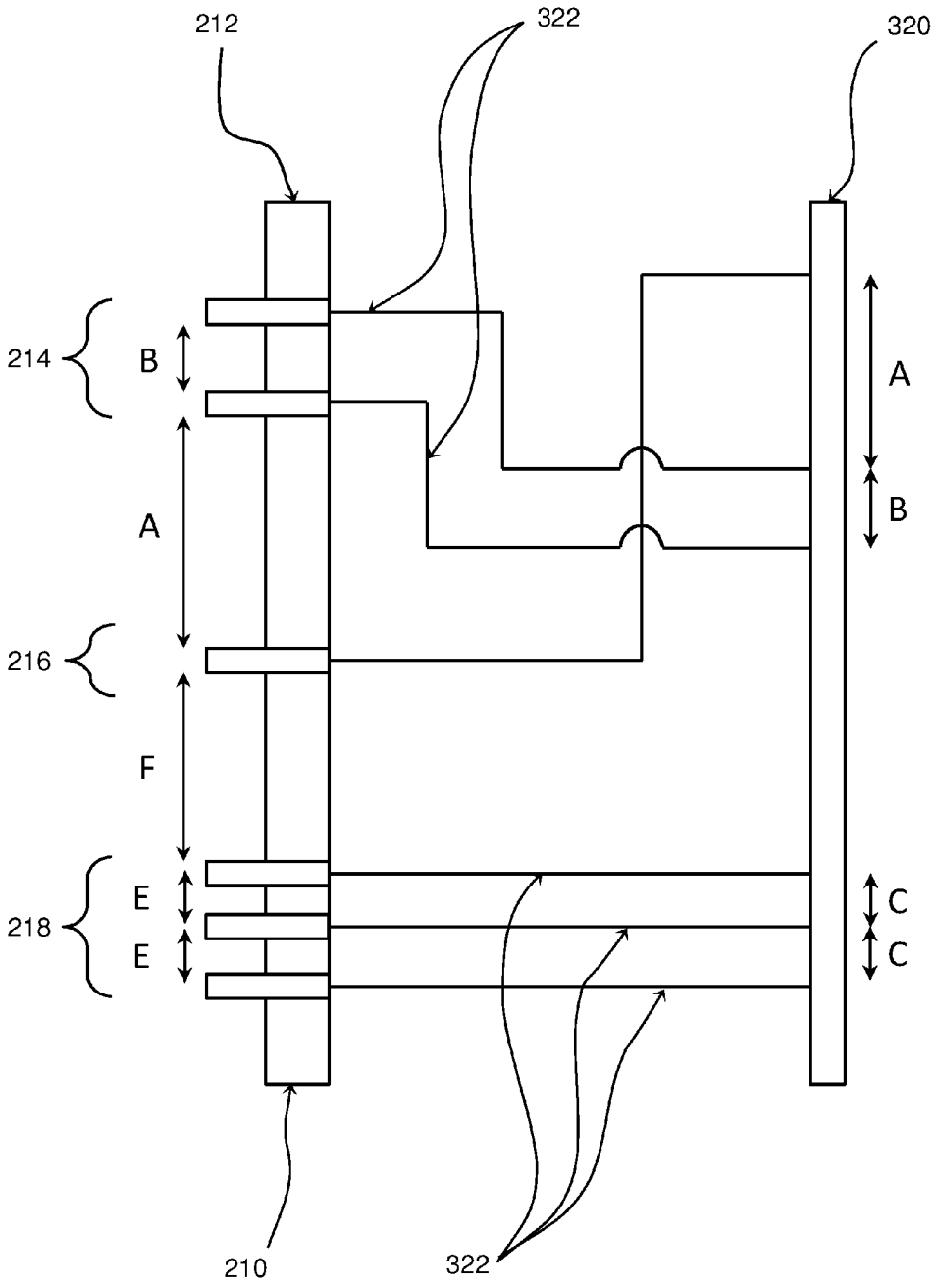
FIG. 3 is a schematic view of the plurality of electrical connectors of FIG. 2 arranged in relation to a common backplane.

Each of the connectors in FIG. 2 is connected to a common backplane 320, as shown in FIG. 3. The common backplane 320 provides a rigid board upon which electrical connections are arranged in parallel to each other. At the backplane 320, each connection is referenced relative to a common ground potential or pin. The electrical linkages at the backplane 320 can be provided as conductive tracks at the board. Therefore, the spacing between the tracks are fixed. The pathway or layout of each of the electrical connections or linkages at the backplane 320 is specifically designed to maintain at least a minimum required spacing.

The electrical connectors 212 described above in relation to FIG. 2 are shown in FIG. 3 connected to the backplane 320. The connectors and connections to the backplane 320 are arranged so as to maintain the required air gap between connections. In particular, the connections to the backplane 320 of the electrical connectors in the first group 214 are arranged in a spaced relation to the connections to the backplane 320 of those connections in the second group 216. The spacing is not less than distance A. Here, distance A is the same minimum spacing described above in relation to the spacing of the first and second group of connectors 214, 216 at the flange 210. Distance A scales with the difference in the average potential carried by each of the first group 214 and second group 216 of connectors and connections to the backplane 320. Specifically, the distance A scales exponentially with the difference in the average potential carried by each group.

In FIG. 3, the third group of electrical connectors 218 are also connected to the common backplane 320. These are connected spaced from both the first group 214 and the second group 216. In particular, the third group 218 is spaced from the second group 216 by a distance not less than F. In this example, these distances or spacing are the same minimum spacing as described above for the arrangement of the electrical connectors in the flange 210. Therefore, the spacings are established according to the difference in the average potential carried by each of the first, second and third group 214, 216, 218. Where there is a larger difference in potential, the spacing required between the connections in order to avoid micro-discharging is larger.

Furthermore, each of the electrical connectors of the first group 214 are spaced from each other when connected to the backplane 320. For example, the connections to the backplane 320 of the first group 214 are spaced from each other by a distance B, and the connections of the third group 218 are spaced from each other by a distance E. The spacings shown in FIG. 3 correspond to those shown in FIG. 2.

In some circumstances, the connections to the backplane 320, and more especially the groups 214, 216, 218 of connections to the backplane 320, may be arranged so as to provide a potential gradient across the backplane 320. In other words, the connections may be provided such that each of the high-voltage connections are arranged at a first end or region of the planar surface of the backplane 320, with the low voltage connections arranged at the opposite end or a region opposite on the planar surface of the backplane 320. The remaining connections, carrying an intermediate voltage, can be configured in between. Therefore, an electrical potential gradient is created across the backplane 320.

The example shown in FIG. 3 uses rigid wires 322 to connect each of the connectors to the common backplane 320. In other words the wires or leads 322 are stiff and can be formed or shaped, with wires 322 retaining the formed shape. Each of the rigid wires 322 is shaped to maintain spacing between each wire 322. The wires 322 may be required to cross each other, especially if the configuration of connectors at the flange 210 does not correspond to the required gradient of electrical potential preferred at the backplane 320.

Therefore, use of rigid or fixed shape wires 322 is particularly beneficial to maintain a fixed configuration of the connections or linkages between the electrical connectors at the flange 210 and the backplane 320. In contrast, use of flexible wires would allow a possibility of movement of the linkages, and therefore could result in a reduction of the air gap and possible micro-discharges or even arcing between the wires.

As shown in FIG. 3, the rigid wires 322 are shaped so as to maintain the previously required spacings between the groups of connectors 214, 216, 218, according to the voltage carried. As such, each of the rigid wires 322 connected to a connector in the first group 214 is spaced form a wire connected to a connector of the second group 216 by at least a spacing A, for example. Furthermore, the other spacings (e.g. B, C, E or F) between wires connected to connectors of the same group and other groups are also maintained.

The electrical assembly illustrated in FIG. 3 demonstrates a fixed spacing between all of the components according to the potentials carried. This has a number of advantages. First, an air gap is maintained sufficient to prevent micro-discharges between the connections. Secondly, the spacing between each connection can be optimised, without the need to allow excess spacing to account for movement of the wires. Thirdly, the connection assembly is "modular" and allows all of the electrical connections to be moved as one segment or single element.

Figure 4:
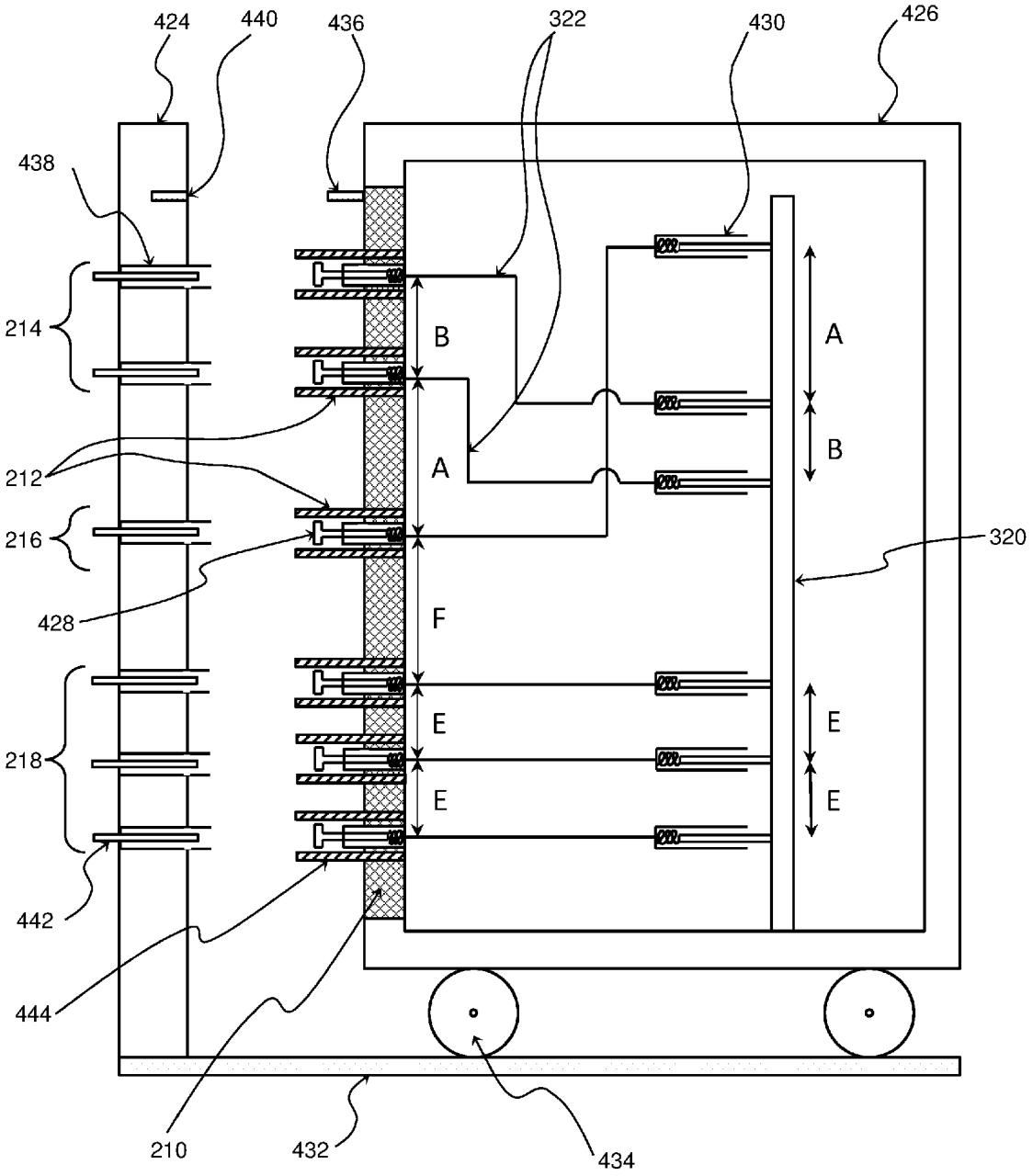
FIG. 4 is a schematic view of a further implementation of the electrical assembly of FIG. 2 and FIG. 3.

A preferred example of the electrical assembly is illustrated in FIG. 4. The flange 210 described above in relation to FIGS. 2 and 3 (and comprising the plurality of electrical connectors 212) is mounted in an outer wall of a cabinet 426. Here the body of the flange 210 is comprised of an insulating material. The backplane 320 discussed with reference to FIG. 3 is housed within the cabinet 426. The plurality of rigid wires 322 are arranged within the cabinet 426 to connect the electrical connectors at the flange 210 and the backplane 320. Use of a cabinet 426 to house the aforementioned electrical assembly allows simultaneous connection or disconnection of each of the plurality of electrical connectors with sockets or connectors 438 arranged in the wall of a scientific instrument 424.

Each of the plurality of electrical connectors at the flange 210 comprises push connectors 428. Each push connector 428 is housed in an insulating casing 444 which surrounds the push connector 428 at the face of the flange 210. The push connectors 428 are arranged to receive an electrical lead 442 of the electrical socket 438 at the scientific instrument 424. When the electrical connectors at the cabinet 212 and the electrical connectors 438 at the scientific instrument 424 are joined, the electrical lead 442 pushes against the push connector 428, causing the push connector 428 to be biased against the electrical lead 442.

Use of push connectors 428 prevents the formation of any small air gaps at the connectors and also helps provide better electrical contact. Furthermore, use of an insulating casing 444 surrounding each push connector 428 provides an additional resistance between the high voltage lead and ground. The push connectors 428 together with the insulating casing 444 and insulating flange 210 significantly reduce the minimum required spacing to prevent micro-discharging.

As shown at FIG. 4, push connectors 428 are also provided at the connection of each rigid wire 322 to the backplane 320. Once again, this ensures good electrical contact between the rigid wires 322 and the backplane 320.

The cabinet 426 is sealed such that the interior of the cabinet is electrically insulated from the outside of the cabinet. In other words, the cabinet 426 forms a sealed, insulated chamber or module. This allows the cabinet 426, which will contain high-voltage connections, to be handled more safely. A single input power supply (not shown) may be provided to the cabinet 426, and more specifically to the backplane 320. This helps to regulate the electrical connections at the backplane 320, such that the potential carried by each of the connections is referenced to a common voltage supply.

The sealed cabinet 426 is provided with an air conditioner (not shown in FIG. 4). The air conditioner regulates the properties of the air within the cabinet 426. Specifically, the air conditioner regulates the temperature and the humidity of the temperature within the cabinet 426. Regulation of the temperature of the interior of the cabinet 426 helps to reduce discharging events and to maintain the overall stability of the voltage supplied through the rigid wires 322 and electrical connectors 212.

The cabinet 426 of FIG. 4 is further mounted on a rail 432. In the example shown, the cabinet 426 is mounted having wheels 434 which connect to the rail 432, although other types of movable connection to the rail 432 may be envisaged by the skilled person. Rail mounting of the cabinet 426 allow for easier connection or disconnection of the plurality of electrical connections at the flange 210. This is particularly beneficial to allow disconnection of the electrical connections for maintenance or sample loading. The plurality of electrical connections 212 may be easily disconnected or connected simultaneously by movement of the cabinet 426 on the rail 432, relative to the scientific instrument 424.

The cabinet 426 further comprises an alignment device 436, 440 to assist the user in correct alignment of the cabinet 426 with the scientific equipment 424. The alignment device 436, 440 shown in FIG. 4 is a pin 436 at the cabinet 426, which is received by a socket 440 at the scientific instrument 424. However, the alignment device could consist of alignment marks at the cabinet and scientific equipment, or another type of alignment device.

Modifications to the features of the described embodiments will be readily apparent to the skilled person, and these are intended to form part of the invention. For example, the rigid wires 322 may comprise an insulating covering along the majority of their longitudinal length. In other words, the rigid wire may be coated with an insulating material (for example, Teflon) which encapsulates the wire along its length, exposing only the ends of the wire which make contact with other components. Where an insulating covering is used, the spacing between the rigid wires 322 required to prevent micro-discharging may be less than required when the wires are uncovered.

As described above with reference to FIG. 4, each of the electrical connectors 212 may comprise an insulating casing 444. This insulating casing 444 forms an insulating wall around the perimeter of each electrical connector 212. In other words, the electrical connector 212 is concentric with the insulating casing 444. The insulating casing 444 may be advantageous for "blocking" the gap between connectors, thereby increasing the resistance of any charge carrying pathway formed between the two. Furthermore, the surface distance across the insulator is increased. Because of this, the overall spacing required between the two connectors or groups of connectors may be less than would otherwise be required to prevent micro-discharging. In other words, the effective spacing or air gap between the connectors is greater than the actual spacing. In other examples, the plurality of electrical connectors 212 may not comprise an insulating casing. Where this is the case, the spacing required between the electrical connectors in order to prevent micro-discharging will be greater.

In the example of FIG. 4, the spacing is described as being the same between different groups of electrical connectors, rigid wires and connections to the backplane. This is the minimum spacing required to prevent micro-discharging. However, in some configurations the minimum spacing may be different between different components of the assembly. For example, by use of the insulating casing 444 around each of the plurality of electrical connectors 212, the spacing between connectors required to avoid micro-discharging may be reduced. Similarly, use of an insulative covering around the rigid wires 322 may reduce the necessary spacing. However, between the connections to the backplane where no additional insulation is provided, the spacing required may be comparatively larger. The electrical connection assembly may be arranged so as to minimise the spacing between each component of each group. Therefore, in some circumstances the spacing between the first group of electrical connectors and the second group of electrical connectors, for example, may be less than the spacing between the connections of the first group to the backplane and the connections of the second group to the backplane. Advantageously the spacings will be optimised such that the distances maintained between groups carrying voltage of different magnitude is maintained at greater than that required between any given component.

Although the plurality of electrical connectors illustrated at FIG. 4 and described above considers a push connector to receive an electrical lead, the described electrical assembly would be equally advantageous if the plurality of electrical connectors comprise plugs or sockets. In particular, the plurality of electrical connectors may each comprise a high-voltage feedthrough assembly as described above in relation to FIGS. 1A and 1B. This may provide additional advantages for optimising the spacing required to prevent micro-discharging.

The high voltage feedthrough assembly and the electrical connection assembly described above are particularly beneficial for use in a mass spectrometer. Mass spectrometers require supply of high voltage (for example 10 kV) to the ion source. Furthermore, the voltage applied to the mass spectrometer must be very stable, in order to allow measurements having the highest resolution. Because of the requirement for high stability of the applied potentials, micro-discharging events can be particularly problematic, and may be observed at the air interface of the high-voltage connectors at the outside of the mass spectrometer. Furthermore, a large number of electrical connections to the mass spectrometer may be required, with a large range of voltages. As such, the risk of micro-discharges between different connectors is increased.

In view of these considerations, the high voltage feedthrough assembly described above can be particularly beneficial when implemented at the electrical connections of a mass spectrometer. A plurality of the high voltage feedthroughs described above may be arranged at the wall of a chamber housing the mass spectrometer.

Figure 5:
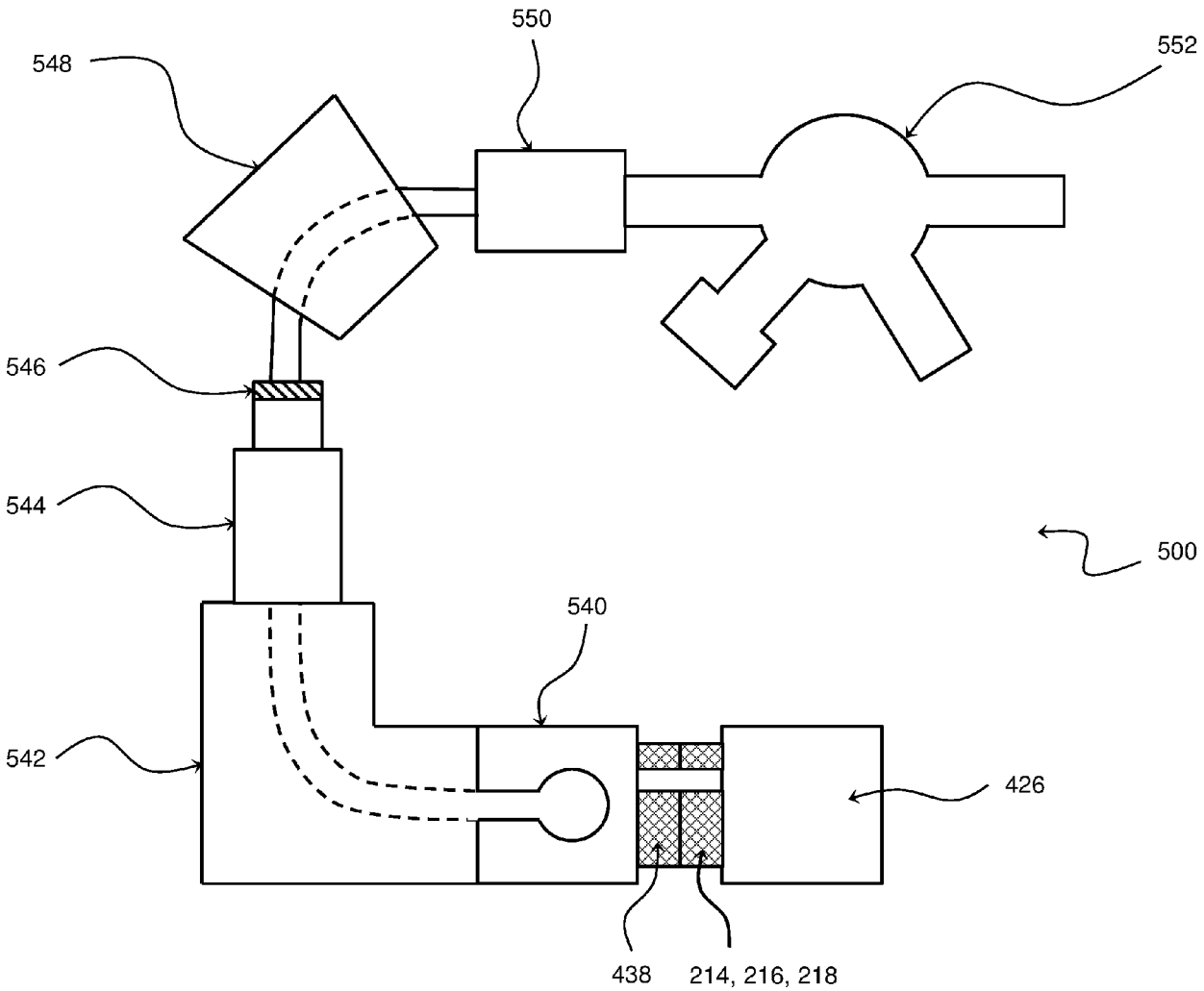
FIG. 5 is a schematic view of a mass spectrometer comprising the high voltage feedthrough assembly and the electrical assembly.

A particular embodiment of the mass spectrometer incorporating the high voltage feedthrough assembly and the electrical connection assembly is shown in FIG. 5. FIG. 5 shows a schematic representation of a double focussing mass spectrometer 500. The ions are generated at the ion source 540 which is powered by a modular power supply 426 connected via connectors 214, 216, 218, 438. The ions are accelerated and passed through the electrostatic analyser (ESA) 542 which assists in focussing the ion beam and selecting ions of the required energy. The ions next enter a focussing quadrupole 544 to further focus the ion beam. On exiting the focus quadrupole, the ion beam passes through an adjustable aperture plate 546 and then onwards through a magnetic field at the electromagnetic sector 548. The magnetic field separates the ions within the ion beam according to their mass-to-charge ratio. The separated ion beam is subsequently passed through a dispersion quadrupole 550 and then to the detector 552 for analysis.

The power supply module 426 may comprise the electrical connection assembly as described above in relation to FIG. 4. For example, the power supply may comprise the rail mounted cabinet 426, comprising a plurality of electrical connections 212 to a backplane 320 having fixed configuration and spacing. Each of the connectors 214, 216, 218, 438 may comprise flanges 210 each having a plurality of electrical connectors 212 arranged therein. The electrical connectors 212 may be arranged in an ordered or graded fashion according to the example described above with reference to FIG. 3.

Furthermore, each of the electrical connectors at the mass spectrometer may comprise the high voltage feedthrough assembly 100 described above in relation to FIG. 1. These may reciprocate with the electrical connectors of the power supply according to the example described above in relation to FIG. 4.

Many combinations, modifications, or alterations to the features of the above embodiments will be readily apparent to the skilled person and are intended to form part of the invention. Any of the features described specifically relating to one embodiment or example may be used in any other embodiment by making the appropriate changes.

The invention claimed is:

1. A high voltage feedthrough assembly comprising:

(a) an electrical lead extending in a longitudinal direction;

(b) an insulative cover capturing the electrical lead and extending along the electrical lead in the longitudinal direction, the insulative cover having a width defined in an axis perpendicular to the longitudinal direction;

(d) a flange, the insulative cover extending through, and being held by, the flange, so that the electrical lead which is captured by the insulative cover extends through, but is insulated from, the flange;

(c) an adapter body, held in a spaced relation to the flange, the adapter body having a cavity extending therethrough, the width of the cavity of the adapter body being greater than the width of the insulative cover, wherein a portion of the insulative cover and the electrical lead extending from the flange extends into the cavity; and (e) a collar arranged in the adapter body cavity, extending radially between the adapter body and the insulative cover, to hold the insulative cover and electrical lead so that the insulative cover is radially spaced away from the walls of the cavity in the adapter body and so as to support the adapter body in the said spaced relation to the flange.

2. The assembly of claim 1, wherein the collar extends contiguously in the radial direction between the adapter body and the insulative cover, so as to block the cavity in the longitudinal direction.

3. The assembly of claim 1, wherein the spacing in the longitudinal direction between the end of the insulative cover disposed within the cavity of the adapter body, and the face of the flange opposite the adapter body is a minimum distance D.

4. The assembly of claim 1, further comprising a spacer member, arranged to support the insulative cover in a spaced relation to the electrical lead.

5. The assembly of claim 4, wherein the spacer member is formed at an end of the insulative cover disposed within the cavity of the adapter body.

6. The assembly of claim 4, wherein the spacer member is integrally formed with the insulative cover at an end thereof.

7. The assembly of claim 4, wherein the collar is arranged at a position on the longitudinal length of the insulative cover that is between the spacer and the flange.

8. The assembly of claim 4, wherein the collar is arranged at a position on the longitudinal length of the insulative cover that is between the spacer and the face of the adapter body disposed opposite the flange.

9. The assembly of claim 1, wherein the collar is formed of an insulative material.

10. The assembly of claim 1, wherein the collar is an O-ring.

11. The assembly of claim 1, wherein the adapter body is formed of an insulative material such as polyacetal.

12. A mass spectrometer comprising or including the high voltage feedthrough assembly of claim 1.

13. An electrical connection assembly for a scientific instrument, comprising;

a plurality of electrical connectors arranged in a flange, for reciprocation with a plurality of electrical sockets at the scientific instrument, the plurality of connectors being arranged in multiple groups, wherein electrical connectors in a first group and electrical connectors in a second group are separated from each other by a distance not less than a distance A; and a power supply arranged to supply a potential to each of the first group of electrical connectors, the potentials applied across the first group having a first average potential;

the power supply arranged to supply a potential to each of the second group of electrical connectors, the potentials applied across the second group having a second average potential; and wherein the distance A is equal to or greater than a threshold distance determined by the difference between the first average potential and the second average potential.

14. The electrical connection assembly of claim 13, wherein the distance A is exponentially related to the difference between the first average potential and the second average potential.

15. The electrical connection assembly of claim 13, wherein:

the electrical connectors of the first group are arranged in the flange separated from each other by a distance not less than a second distance B; and the electrical connectors of the second group are arranged in the flange separated from each other by a distance not less than a third distance C;

wherein the second distance B and the third distance C is less than the distance A.

16. The electrical connection assembly according to claim 13, further comprising a common backplane, each of the plurality of electrical connectors configured to be connected to the common backplane, and wherein:

the connections of the first group of electrical connectors to the backplane are configured so as to be separated from the connections to the backplane of the second group of electrical connectors, the separation being not less than the distance A.

17. The electrical connection assembly of claim 16, wherein:

the connections to the backplane of each of the first group of electrical connectors are separated from each other by a spacing not less than the second distance B; and the connections to the backplane of each of the second group of electrical connectors are separated from each other by a spacing not less than the third distance C.

18. The electrical connection assembly of claim 16, further comprising a plurality of rigid wires, a rigid wire from the plurality of rigid wires arranged to connect each of the plurality of electrical connectors to the common backplane, wherein the rigid wires are shaped to maintain a spaced relation from each other such that:

each of the rigid wires connecting the first group of electrical connectors to the backplane are separated from each of the rigid wires connecting the second group of electrical connectors to the backplane by a spacing not less than the distance A, wherein the spacing of distance A is maintained along the full length of the rigid wire.

19. The electrical connection assembly of claim 18, wherein each of the rigid wires connecting the first group of electrical connectors to the common backplane are shaped to maintain a spacing from each other not less than the second distance B; and each of the rigid wires connecting the second group of electrical connectors to the common backplane are shaped to maintain a spacing from each other not less than the third distance C.

20. The electrical connection assembly of claim 13, further comprising a push connector at each of the plurality of electrical connectors, the push connector configured for reciprocation with an electrical lead at an electrical socket at the scientific instrument.

21. The electrical connection assembly of claim 13, further comprising a closed cabinet, the flange arranged in a wall of the cabinet, and the common backplane mounted within the interior of the closed cabinet.

22. The electrical connection assembly of claim 21, wherein the interior of the closed cabinet is electrically insulated from the exterior of the closed cabinet.

23. The electrical connection assembly of claim 21, the closed cabinet further comprising an air conditioning module for control of the temperature and humidity of the interior of the cabinet.

24. The electrical connection assembly of claim 21, wherein the closed cabinet is rail mounted such that the closed cabinet can be moved on the rail relative to the scientific instrument between a first position in which the plurality of electrical connections are connected to the scientific instrument and a second position in which the plurality of electrical connections are disconnected from the scientific instrument.

25. The electrical connection assembly of claim 21, further comprising an alignment device at the cabinet, configured to align the plurality of electrical connectors at the cabinet with the plurality of electrical sockets at the scientific instrument.

26. A mass spectrometer comprising the electrical connection assembly of claim 13.

* * * * *